United States Patent [19]

Bates

[11] Patent Number: 4,699,190

[45] Date of Patent: Oct. 13, 1987

[54] EVACUATING APPARATUS

[75] Inventor: William T. D. Bates, Charwelton, England

[73] Assignee: Bilbate Limited, Northants, United Kingdom

[21] Appl. No.: 896,751

[22] Filed: Aug. 14, 1986

[30] Foreign Application Priority Data

Aug. 20, 1985 [GB] United Kingdom ..... 8520785

[51] Int. Cl.[4] ..... B65B 31/04

[52] U.S. Cl. ..... 141/65; 141/98; 141/311 R

[58] Field of Search ..... 141/65, 8, 98, 1, 311 R

[56] References Cited

U.S. PATENT DOCUMENTS

| | | | |
|---|---|---|---|
| 2,303,766 | 12/1942 | Scherbak | 141/65 |
| 3,313,444 | 4/1967 | Katell | 141/65 X |
| 4,278,114 | 7/1981 | Ruberg | 141/65 |
| 4,287,819 | 9/1981 | Emerit | 141/65 X |
| 4,543,980 | 10/1985 | van der Sanden | 141/98 X |

FOREIGN PATENT DOCUMENTS

| | | | |
|---|---|---|---|
| 814711 | 8/1951 | Fed. Rep. of Germany | 141/65 |

*Primary Examiner*—Henry J. Recla
*Assistant Examiner*—Ernest G. Cusick
*Attorney, Agent, or Firm*—Rodman & Rodman

[57] ABSTRACT

The evacuating apparatus is used to evacuate a bottle which is fitted with a sealing cap which has a cap bore that accommodates a displaceable plug. The apparatus comprises a platform on which to stand the bottle, and a plunger directed towards the platform. An actuating arrangement operated by a manually operable lever serves firstly to extend the plunger together with an assembly in which the plunger is mounted, to push the displaceable cap plug from a first, sealing position within the cap to a second, non-sealing position. Continued movement of the actuating lever operates to apply suction through the plunger to evacuate the bottle via the cap bore. After the bottle is evacuated the plunger is further extended by displacement displacing relative to the assembly in which it is mounted, to push the displaceable plug into a third, sealing position within the cap.

10 Claims, 3 Drawing Figures

EVACUATING APPARATUS

BACKGROUND OF THE INVENTION

1. Field of the Invention

This invention relates to an apparatus for evacuating a bottle, vessel or container and has particular, but not sole, utility in the medical field.

2. Cross References to Related Applications

My U.K. patent application No. 85.14616, which corresponds to U.S. patent application Ser. No. 872,042 filed June 6, 1986, which describes a sealing cap for a bottle, vessel or container, which cap includes a valving arrangement permitting the container to be evacuated prior to use, and is then self-sealing. The cap incorporates a plug which is initially in a first position, sealing the cap. For evacuating the container, the plug is pushed inwards to a second position, in which there is a clearance around the plug to allow air to be withdrawn under suction from the container. Finally, immediately after the evacuation, the plug must be pushed inwards to a third position, in which it seals the cap and this seal is assisted by the plug being urged against its seat under the influence of the evacuation in the container. A bottle or other container, fitted with such a cap, may be used for collecting a sample of blood, in which case the cap is arranged to be pierced by a fine tube or needle so as to apply suction through that tube, from within the container, and thus draw a sample of blood into the container. By evacuating the container immediately prior to its use, it can be ensured that there is a predetemined level of vacuum within it and that the vacuum has not dissipated with time.

SUMMARY OF THE INVENTION

I have now devised an apparatus for evacuating a bottle or other container which is fitted with a sealing cap as described above, and which apparatus is simple to operate.

In accordance with this invention, there is provided an apparatus for evacuating a bottle or other container which is fitted with a sealing cap as described above, the apparatus comprising a platform on which to stand the bottle, a plunger directed towards the platform, and means serving upon operation firstly to extend the plunger and push the plug of the cap into its second or intermediate position, then to actuate a suction means to apply suction through the plunger and evacuate the bottle, and finally to extend the plunger further to push the plug into its third position within the cap, sealing the cap.

In an embodiment of this apparatus to be described below, the apparatus is operated manually, involving pulling a lever arm through a given stroke to cause the first extension of the plunger, then a stroke of a piston-and-cylinder suction device, and finally the further extension of the plunger. In this embodiment, an adjustment facility is provided on the stroke which the suction device executes, so that the level of vacuum to be created in the bottle is predetermined.

The apparatus therefore provides for reliable and controlled evacuation of the bottle simply and quickly.

BRIEF DESCRIPTION OF THE DRAWINGS

The presently preferred embodiment of this invention will now be described by way of example only and with reference to the accompanying drawings, in which.

DESCRIPTION OF THE PREFERRED EMBODIMENT

Figure 1:
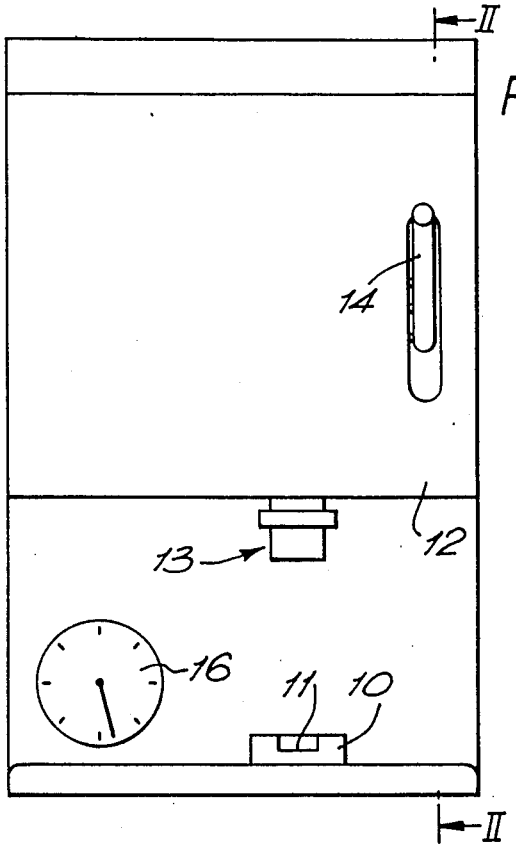
FIG. 1 is a front view of an apparatus for evacuating a bottle or other container.

Referring to FIG. 1, the evacuating apparatus comprises a platform 10 on which to stand a bottle to be evacuated and an overhanging body portion 12 from which a plunger assembly projects downwardly, towards the platform. An operating lever projects forwardly from the front face of the body portion 12 and this lever 14 is manually operated. The apparatus is provided with a pressure gauge 16.

Figure 2:
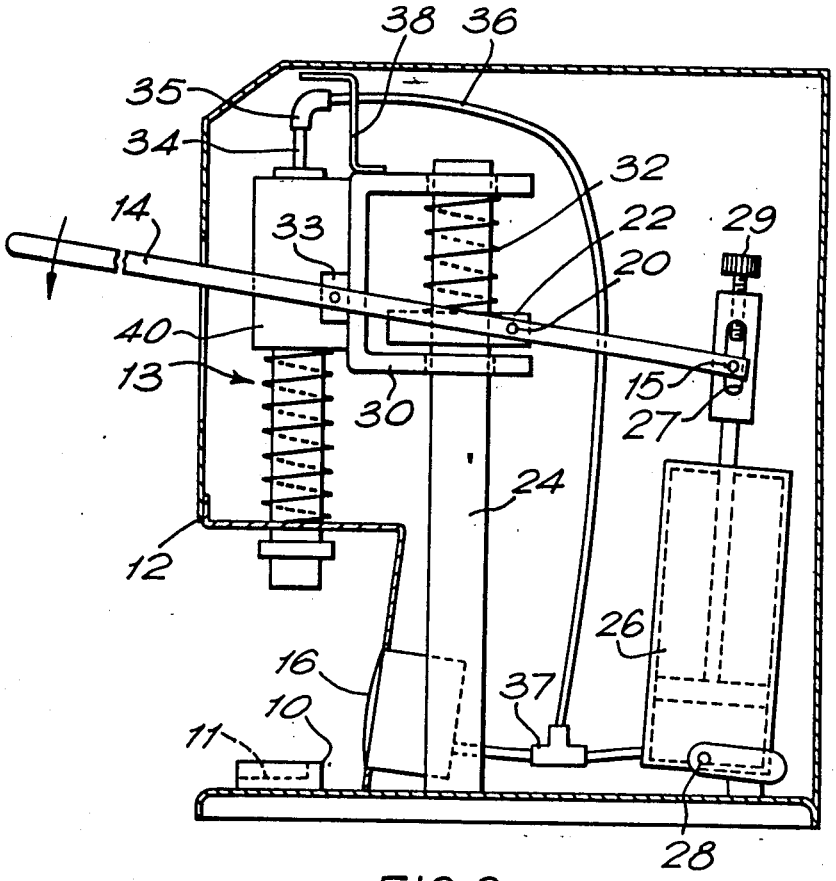
FIG. 2 is a section on the line II—II of FIG. 1 on an enlarged scale and showing the arrangement of operating parts.

Referring to FIG. 2, it will be seen that the lever 14 is pivoted at 20 to a bracket 22 mounted to a fixed vertical shaft 24. At the rear of the apparatus, a piston-and-cylinder suction device 26 is mounted, the cylinder being pivoted to a fixed cradle at 28 and the piston being coupled to the rear end of the lever 14 by a pin 15 on the lever. The pin 15 is also engaged in an elongated slot 27 in the piston rod. A screw 29 is threaded through the end of the piston rod and is adjustable to determine the stroke which the suction device will execute.

A U-shaped bracket 30 is slidably mounted on the shaft 24, the shaft being engaged in round holes formed in the upper and lower limbs of the bracket 30, which limbs are respectively above and below the fixed bracket 22. A return spring 32 acts between the bracket 22 and the upper limb of slidable bracket 30, to return the latter bracket to its normal position at the top of the shaft 24. Forwardly of its pivot point 20 the lever 14 is pivotally coupled to the slidable bracket, at 33.

The plunger assembly 13 is mounted to the front face of the bracket 30. The plunger 34 of the assembly 13 projects out at the top and connects via an elbow connector 35 to a flexible pipe 36 leading from the suction outlet of the suction device 26. The pipe 36 is branched at 37 so as to lead to the pressure gauge 16 also. An extension 38 projects from the slidable bracket 30 to overlie the elbow connector 35 and provide a stop, as will be described below.

Figure 3:
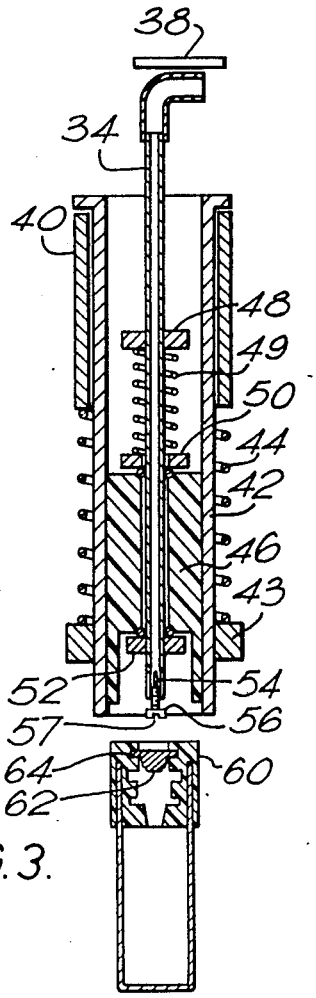
FIG. 3 is an enlarged sectional view of the plunger assembly of the apparatus.

FIG. 3 shows the construction of the plunger assembly 13 in more detail. A sleeve 40 is fixed to the front of the slidable bracket 30. A stainless steel, outer tube 42 slidably guided within the sleeve 40, is provided with a collar 43 near its lower end and a spring 44 which acts between the collar 43 and the sleeve 40. An inner tube 46 of PTFE of similar material is fixed within the outer tube 42 and its lower end terminates just short of the lower end of the outer tube 42.

The plunger 34 extends through a longitudinal through-bore **46*a* in the inner, PTFE tube 46 and a collar 50 which rests on the top end of the inner tube 46. A collar 48 is fixed to the plunger 34 some distance above collar 50 and a spring 49, which may comprise a body of elastomeric material, acts between these two collars. The lower end of the inner tube 46 has its through-bore enlarged in diameter to accomodate another collar 52 fixed to the plunger 34** a short distance above its bottom end.

It will be noted that a sealing O-ring is provided where each of the collars 50,52 seats against the opposite ends of the inner, PTFE tube 46. The bottom end of the plunger 34 is formed with four longitudinal slots 54, spaced equally around its circumference, and a screw 56 is threaded into the end of the plunger, but not so far as to close the slots. The screw 56 has its head formed with two slots 57 across it at right angles.

At rest, the operating lever 14 is urged to an upper position, by the return spring 32 urging the slidable bracket 30 to the top of the shaft 24. Also the spring element 49 of the plunger assembly urges the plunger 34 upwardly within the assembly 13 such that its lower collar 52 is pressed against the internal shoulder of the inner, PTFE tube 46 and the botton end of the plunger (i.e. the head of the screw 56) is approximately level with the bottom end of the outer, stainless steel tube 42.

Then in use, the bottle to be evacuated (complete with its sealing cap 60) is placed in position, by tilting its top towards the apparatus, engaging its cap 60 within the end of the outer tube 42. Thus the top end of the cap-bore receives the plunger-end, and the bottom end of the bottle is swung in towards the apparatus to engage into the slot 11 of the platform 10 from the front and rest against the back of the slot 11. Then the operating lever 14 is moved downwards by hand: firstly this lowers the slidable bracket 40 slightly and with it the plunger assembly 13 so that the lower end of the inner, PTFE tube 46 is pressed onto the top of the rubber cap 60 of the bottle so as to form as sealing engagement with the cap 60 around its bore, and also the bottom end of the plunger 34 (i.e. the screw 56) is brought down (without the plunger yet moving relative to the PTFE tube 46) so as to press the plug 62 of the cap 60 inwards and to displace this plug into its second or intermediate position.

Thus the plug 62 is now engaged with its diaphragm 64 in the middle one of the three grooves formed in the through-bore of its cap 60, instead of being in the upper groove (where it sealed the cap). In its middle position, there is clearance all around the plug for air to be extracted. As the lever 14 continues to be moved downwards, its pin 15 will come into contact with the adjusting screw 29 of the suction piston and then drive the suction device through a stroke. Suction will thus be applied through pipe 36 and through the plunger 34 and its bottom-end slots 54 to the space or chamber 47 within the inner tube 46 at its bottom end. The suction is applied from here, through the cap 60 and to the interior of the bottle to evacuate the bottle.

Towards the end of the movement of the lever 14, the bracket or stop 38 comes into contact with the elbow connector 35 on the top of the plunger 34, and presses the plunger downwards, against the bias of the spring element 49, to displace the plug 62 of the cap 60 downwards and into its final, sealing position within the cap. The diaphragm 64 of the plug 62 is now engaged into the lowest of the three grooves in the cap 60 and the plug body 62 is tightly engaged into the lowermost and smalest-diameter portion of the through-bore in the cap 60. When the lever 14 is now released, the return spring 32 returns the slidable bracket and the plunger assembly to their original, upward positions and the suction device piston to its original lowered position. Also the spring element 49 returns the plunger 34 to its original position within the PTFE tube 46 (i.e. with its collar 52 against the shoulder within the PTFE tube). The evacuated bottle can now be removed for use.

It will be appreciated that the pressure gauge 16 will indicate the level of vacuum being created within the bottle during the suction stroke. The platform 10 may be made removable so that it can be replaced by alternative platforms of e.g. greater height and/or with wider slots 11 to suit bottles or containers of different heights or diameters.

I claim:

1. An apparatus for evacuating a bottle fitted with a sealing cap which has a bore housing a displaceable plug, the apparatus comprising a platform on which to stand the bottle, support structure overhanging said platform, a plunger displaceably mounted to said support structure and directed towards the platform, a suction device and actuating means coupled to said plunger and to said suction device and serving upon operation firstly to extend the plunger a first distance towards said platform and push the plug of the cap from a sealing position to a non-sealing position within said cap bore, said actuating means then serving to actuate said suction means to apply suction through the plunger and evacuate the bottle via said cap bore, and said actuating means finally serving to extend the plunger a further distance towards said platform to push the plug into another sealing position within the cap.

2. An apparatus as claimed in claim 1, comprising a plunger assembly displaceably mounted to said support structure and in which said actuating means comprises means for displacing said plunger assembly in a direction towards said platform upon operation of said actuating means, said plunger assembly mounting said plunger and comprising an outer end forming sealing engagement with said cap around its bore as said plunger contacts and pushes said plug to said non-sealing position.

3. An apparatus as claimed in claim 2, in which said actuating means comprises means for displacing said plunger relative to said plunger assembly to push said plug to said other sealing position.

4. An apparatus as claimed in claim 3, in which said plunger assembly comprises a bore in which said plunger is sealingly displaceable and a chamber formed in the end of said plunger assembly, and the plunger is provided with a through-bore for applying suction to said chamber and thence to said bottle via said cap bore.

5. An apparatus as claimed in claim 1, in which the suction device comprises a piston-and-cylinder suction device and said actuating means comprises means coupled to the piston of said device to move the piston through a stroke to create said suction.

6. An apparatus as claimed in claim 1, in which said actuating means comprises an operating lever pivoted about a fixed point and having the plunger and suction device coupled to said lever such that, upon pivoting movement of the lever, firstly the plunger is extended said first distance, then the suction device is actuated and finally the plunger is extended said further distance.

7. An apparatus as claimed in claim 6, in which said operating lever is manually operable.

8. An apparatus as claimed in claim 1, comprising a plunger assembly displaceably mounted to said support structure and in which said actuating means comprises means for displacing said plunger assembly in a direction towards said platform upon operation of said actuating means, said plunger assembly mounting said plunger and comprising an outer end forming sealing engagement with said cap around said bore as said plunger contacts and pushes said plug to said non-sealing position, further in which said actuating means comprises an operating lever pivoted about a fixed point and having the plunger and suction device coupled to said lever such that, upon pivoting movement of the lever, firstly the plunger is extended said first distance, then the suction device is actuated and finally the plunger is extended said further distance, and further in which the plunger assembly is displaceably mounted to a bracket and a biasing means is provided to urge the plunger assembly in a direction away from said platform, said bracket being coupled to said lever.

9. An apparatus as claimed in claim 8, in which said bracket carries an abutment for contacting said plunger to displace said plunger relative to said plunger assembly over a final portion of movement of said operating lever.

10. An apparatus as claimed in claim 1, in which said platform is removable and replaceable by alternative platforms of different dimensions to suit bottles of different dimensions.

* * * * *